United States Patent [19]

Freville et al.

[11] Patent Number: 4,796,310

[45] Date of Patent: Jan. 10, 1989

[54] BATHTUB DRAIN VALVE CONTROL AND OVERFLOW PLATE

[75] Inventors: Robert Freville, Sheboygan Falls; Philip Segor, Sheboygan, both of Wis.

[73] Assignee: Kohler Co., Kohler, Wis.

[21] Appl. No.: 89,923

[22] Filed: Aug. 25, 1987

Related U.S. Application Data

[63] Continuation of Ser. No. 885,055, Jul. 14, 1986, abandoned.

[51] Int. Cl.[4] ..... E03C 1/24

[52] U.S. Cl. ..... 4/199; 4/198

[58] Field of Search ..... 4/191, 195, 198–204, 4/206, 208, 651

[56] References Cited

U.S. PATENT DOCUMENTS

| | | | |
|---|---|---|---|
| 433,718 | 8/1890 | Bunting, Jr. | 4/198 |
| 563,064 | 6/1896 | Putnam . | |
| 2,184,001 | 12/1939 | Nystrom . | |
| 2,572,463 | 10/1951 | Fine | 4/195 |
| 2,706,298 | 4/1955 | Holycross, Jr. . | |
| 2,832,081 | 4/1958 | Young | 4/199 |
| 2,859,453 | 11/1958 | Bloch . | |
| 2,910,704 | 11/1959 | Kinsey et al. . | |
| 3,855,648 | 12/1974 | Dunham . | |
| 4,085,469 | 4/1978 | Petursson . | |
| 4,194,251 | 3/1980 | Pennerstorfer | 4/199 |

FOREIGN PATENT DOCUMENTS

| | | | |
|---|---|---|---|
| 385757 | 3/1965 | Switzerland | 4/200 |

OTHER PUBLICATIONS

Kohler Co. Catalog page describing the "Clearflo" Drain.

WaterJet Corporation brochure page describing the "Bath Womb".

*Primary Examiner*—Henry J. Recla
*Assistant Examiner*—Linda J. Sholl
*Attorney, Agent, or Firm*—Quarles & Brady

[57] ABSTRACT

A bathtub drain valve control arrangement includes an overflow cover movably mounted in a recessed pocket of a substantially vertical bathtub wall so as to cover the overflow opening in that wall. The overflow plate is adapted to move between open and closed positions and has a smooth outer surface so that, in the closed position, it is flush with the vertical bathtub wall to provide a smooth, substantially continuous surface against which a bather could comfortably lean. A linkage connects the overflow cover and a drain valve, so that moving the overflow plate to the open position opens the drain valve and moving the overflow plate to the closed position closes the drain valve.

4 Claims, 3 Drawing Sheets

FIG. 1
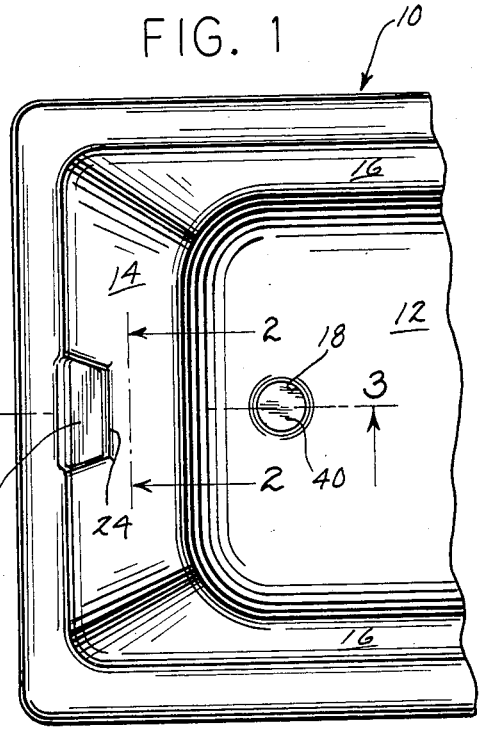
FIG. 2
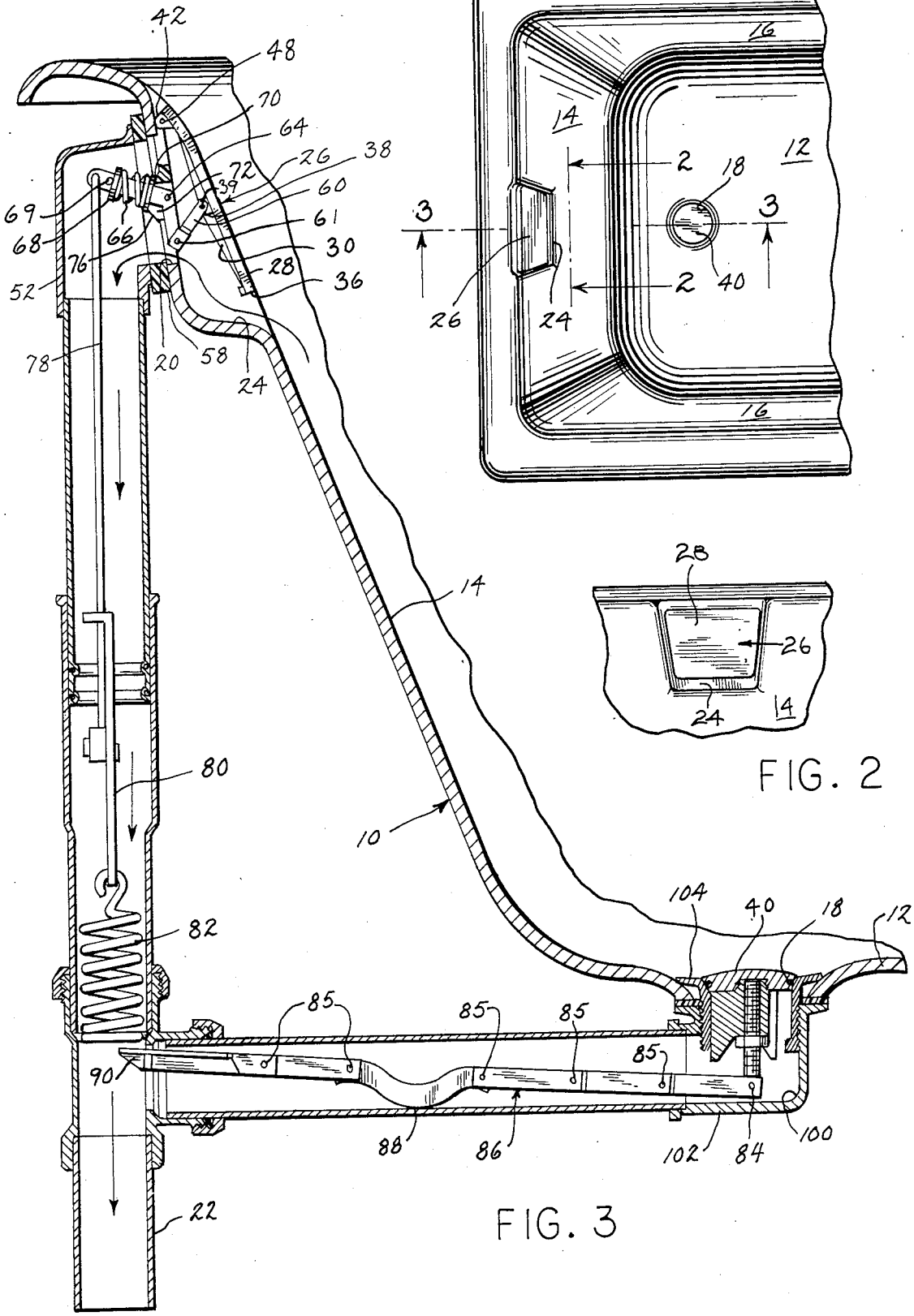
FIG. 3

BATHTUB DRAIN VALVE CONTROL AND OVERFLOW PLATE

This application is a continuation of application Ser. No. 885,055, filed Jul. 14, 1986, now abandoned.

BACKGROUND OF THE INVENTION

This invention relates to bathtub drain valve controls. More particularly it relates to a drain control that is operated by an overflow cover that forms a smooth extension of the tub wall.

Almost all bathtubs have a drain opening at the bottom for draining out the water and a valve located in that drain opening for closing the drain. Such bathtubs usually have an overflow opening which is in fluid communication with the drain. The overflow opening is located on a vertical wall of the tub and permits water to flow out to the drain in order to prevent the tub from overflowing in case someone forgets to turn off the water or in case a person enters the tub and raises the water level to too high a level.

Usually, a stationary overflow plate is mounted on the tub to conceal the overflow hole from view while leaving a bottom hole open. The overflow plate is usually fixed on the bathtub wall and juts out from the normal surface of the wall. It is also common for a drain control lever to be movably mounted on the fixed overflow plate and to extend into the tub. The drain control lever is then connected through linkages to the drain valve at the bottom of the tub.

One problem with such drain valve controls and overflow plates of the prior art is that they project out into the tub so that they would stick into the back of a person who tries to lean against the wall in which they are mounted. This limits the use of many tubs to one person at a time.

To solve this problem, there have been attempts to separate the overflow cover and drain lever (by recessing the trip lever in a pocket and then using a separate cover to form a smooth rest surface). Such systems require the user to both lift the cover and also trip a separate lever to control the drain.

SUMMARY OF THE INVENTION

The present invention provides a combination of drain valve control lever and overflow plate which is shaped and installed so as to complement the contours of the vertical bathtub wall to provide a smooth, substantially continuous surface against which a bather can comfortably lean.

The present invention also provides an overflow plate which itself moves in order to serve the additional function of drain control lever.

In one aspect, the bathtub drain control arrangement of the present invention includes a substantially vertical bathtub wall defining an overflow opening which is adapted to communicate with a downwardly directed drain, a bathtub floor defining a drain opening which is adapted to communicate with the drainpipe, a drain valve located in the drain opening for opening and closing fluid communication through the drain opening, an overflow cover movably mounted on the substantially vertical bathtub wall so as to substantially conceal the overflow opening, the overflow cover being adapted to move between open and closed positions and having a generally smooth outer surface, such that, in the closed position, the overflow cover is substantially flush with the vertical bathtub wall to provide a surface against which a bather could comfortably lean, and a linkage connecting the overflow cover and the drain valve, so that moving the overflow cover to the open position opens the drain valve, and moving the overflow cover to the closed position closes the drain valve.

In another aspect, the present invention is a drain control fitting suitable for mounting on a bathtub side wall through an overflow hole in the side wall, and suitable to be connected to a drain valve drive member positioned behind the side wall. The fitting comprises a cover suitable to cover at least a portion of the overflow hole, a connection means for mounting the cover on the side wall in a pivoting fashion, such that the cover may swing towards and away from the side wall while mounted on it on a first pivot axis, a lever suitable to be connected to the drain valve drive member such that operation of the lever moves the drive member, a second pivot axis upon which the lever pivots, and linking means for linking the cover to the lever such that pivoting of the cover on the first axis pivots the lever on the second axis.

One object of the present invention is to provide a simpler overflow cover and drain valve control than previously available.

Another object is to provide a relatively inexpensive overflow cover and drain valve control.

Another object is to provide an overflow cover and a drain valve control combination that is easy to operate.

Another object is to provide an overflow cover and drain valve control that are mounted so as to provide a smooth surface against which a person can lean his back.

Another object is to provide a bathtub in which two people may comfortably sit face to face, leaning against opposite walls of the tub.

BRIEF DESCRIPTION OF THE DRAWINGS

FIG. 1 is a top, broken away view of a bathtub including the drain valve control arrangement of the present invention;

FIG. 2 is a frontal view taken along the line 2—2 of FIG. 1;

FIG. 3 is a view taken along the section 3—3 of FIG. 1;

DESCRIPTION OF THE PREFERRED EMBODIMENT

Figures 4, 6:
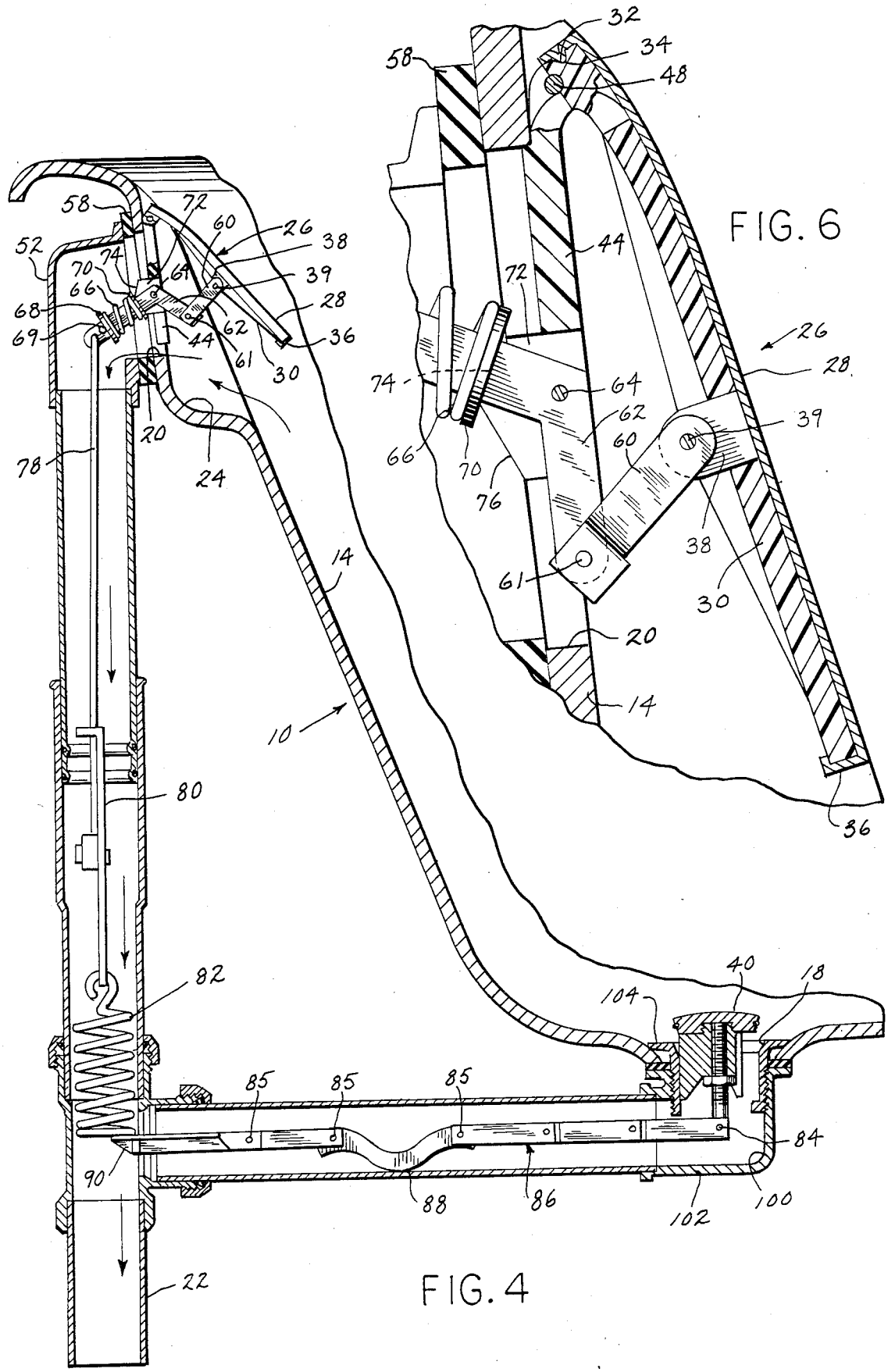
FIG. 4 is the same view as FIG. 3, but with the drain lever and drain valve in the open position.
FIG. 6 is an enlarged, side sectional view of the valve control lever region of FIG. 3.

The bathtub 10 has a bottom wall 12, a substantially vertical side wall 14, and two substantially vertical side walls 16. There is the usual hole 18 in the bottom wall (or floor) 12 of the tub 10 which serves as a drain hole. There is also an opening 20 in the vertical end wall 14 which serves as an overflow opening. Both the drain opening 18 and the overflow opening 20 are in fluid communication with the drainpipe 22. The end wall 14 has a recessed portion (or pocket) 24 surrounding the overflow opening 20.

The recessed portion 24 is tapered as shown in the FIG. 3 cross section, being narrow at the top and wider at the bottom. An overflow plate 26 is mounted in the recessed portion 24 to conceal the overflow opening 20 from view. The overflow plate or cover 26 is slightly recessed in the end wall 14 when in the FIG. 3 position. The recessed portion or pocket 24 extends slightly below the overflow plate 26 so that a person can reach his fingers underneath the free end of the overflow plate 26 to pull it outward and so that water can readily overflow through the overflow opening 20 (as indicated by the arrows in FIG. 3).

The overflow plate 26 is preferably made in two pieces. The outer piece 28 is preferably metallic and may have a finish which corresponds to the finish on the faucet and other fixtures used in conjunction with the bathtub 10. It has a generally smooth outer surface which, when the plate 26 is closed, is flush with the rest of the tub wall 14 and complements the contours of the vertical bathtub wall 14 to provide a smooth, substantially continuous surface against which a bather could comfortably lean.

The inner piece 30 is preferably a molded polymeric material (e.g. a plastic). The inner piece 30 has an indentation 32 in its top edge (see FIG. 6), and the outer piece 28 has a mating projection 34. In order to assemble the outer piece 28 on the inner piece 30, the bottom portion 36 of the outer piece is first wrapped around the lower edge of the inner piece 30, and then the projection 34 at the top of the outer piece 28 is snap-fit into place in the indentation 32 of the inner piece 30.

The inner piece 30 includes an integrally molded arm 38 defining an aperture 39 which permits the overflow plate 26 to be connected to the linkages used to control the drain valve 40. The inner piece 30 also includes a number of hinge eyes 42 near its top edge.

A stationary member 44 has mating hinge eyes 46 on its top edge. A hinge pin 48 connects the overflow plate 26 to the stationary piece 44 through the hinge eyes 42, 46, so that the overflow plate 26 can pivot relative to the tub 10 on this first, substantially horizontal axis. Thus, the overflow plate 26 is movably mounted on the tub 10 at its top end and has a free lower end. It should be noted that the outer piece 28 projects slightly beyond the hinge eyes 42, 46 to conceal them.

Figure 5:
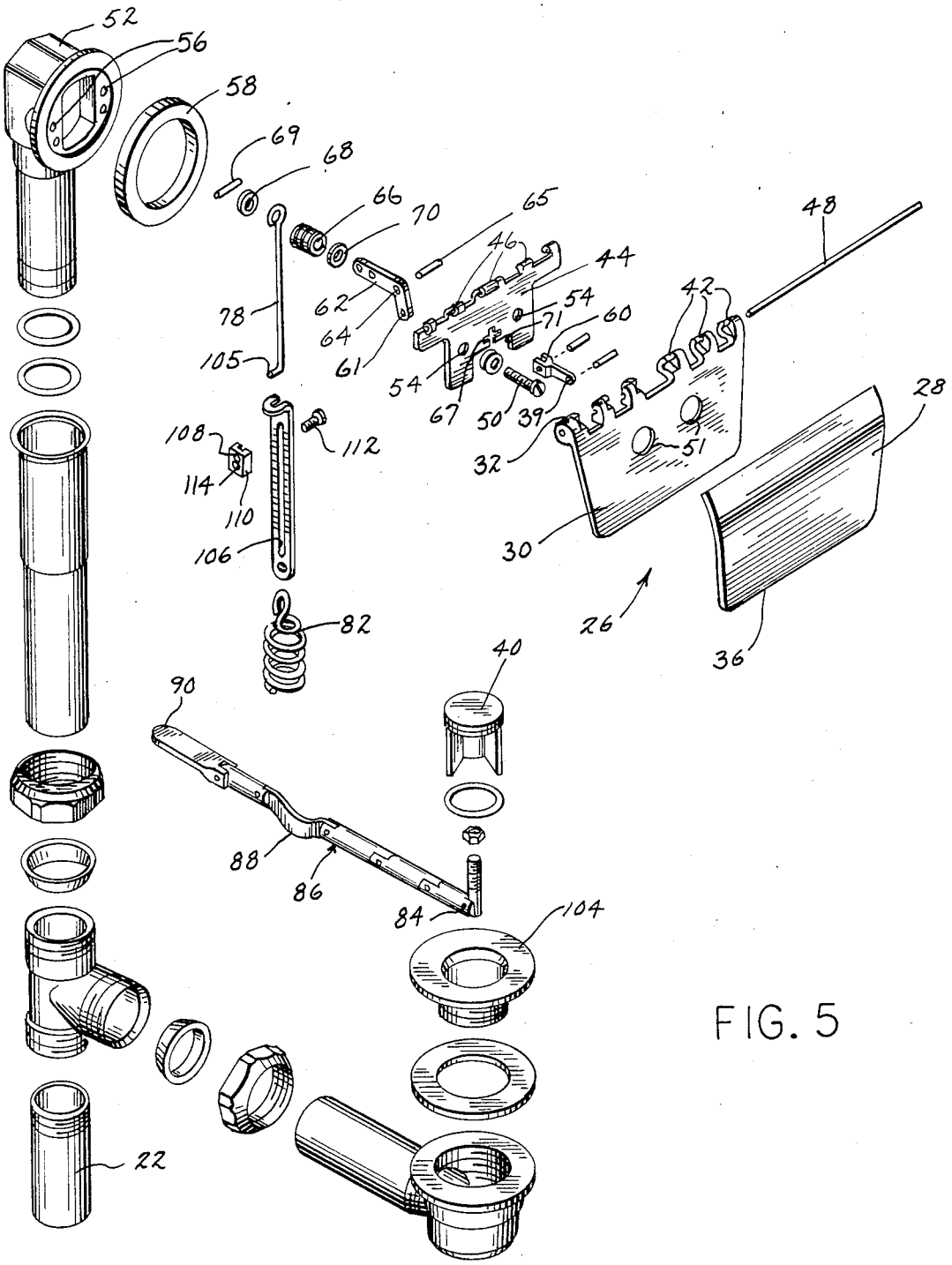
FIG. 5 is an exploded perspective view of the parts which are connected to the bathtub to form the drain valve control arrangement of FIG. 1.

The stationary piece 44 is fixed to the end wall 14 of the tub 10 by means of two screws 50 (only one shown in FIG. 5) which clamp the stationary piece 44 and the drain extension 52 to the end wall 14 of the tub. The screws 50 extend through apertures 54 in the stationary piece 44 and through the overflow opening 20 in the tub wall 14 and are received in the threaded apertures 56 of the drain extension 52. A gasket 58 is pressed between the drain extension 52 and the outer surface of the end wall 14 to provide a seal between the drain extension 52 and the end wall 14.

The linkages which permit the overflow plate 26 to serve as a drain valve control lever are as follows (see FIGS. 5 and 6): A Y-shaped linkage 60 is pivotably connected at the point 39 to the arm 38 which is integral with the inner piece 30 of the overflow plate 26. At its other end, the linkage 60 is pivotably connected to a rocker arm 62 at the point 61. The rocker arm 62 is pivotably mounted on the stationary piece 44 at the point 64, so that the rocker arm 62 pivots about the fixed point (or second, substantially horizontal axis) 64. A spring 66 is mounted over the inner portion of the rocker arm 62 between two washers 68, 70, which serve as stops.

The washer 70 bears against an integral extension 72 from the stationary piece 44 which extends through the end wall 14 of the tub. The extension 72 has upper and lower camming surfaces 74, 76 which serve to define the two positions of the overflow plate (or valve control lever) 26.

When the overflow plate 26 is in the closed position, as shown in FIGS. 3 and 6, the washer 70 bears against the upper camming surface 74. When the overflow plate 26 is pivoted counterclockwise (opened), the washer 70 begins to move toward the lower camming surface 76. As the rocker arm is rotated counterclockwise, the washer 70 moves until it is balancing on the point between the first and second camming surfaces 74, 76. When the rocker arm 62 moves slightly beyond the balanced position, the spring 66 causes the washer 70 to flip into contact with the lower camming surface 76, snapping the overflow plate (the valve control lever) 26 into the open position, shown in FIG. 4. When closing the valve control lever 28, the spring 66 acts in a similar manner, causing the washer 70 to flip into contact with the upper camming surface 74 as it moves past the balanced position.

At its innermost end, the rocker arm 62 is pivotably connected to the vertical linkage (or drive member) 78, the length of which is adjustable by means of an adjustment arm 80. The lower end of the adjustment arm 80 is connected to a spring 82. The drain valve 40 is pivotably connected at the point 84 to a see-saw assembly 86 which rocks back and forth about the fulcrum point 88. The assembly 86 can flex inward about the points 85, permitting it to be installed through the drain hole 18, but it cannot flex outward, thereby permitting it to operate stiffly, in a see-saw motion when acted on by a downward force at either end.

When the overflow plate 26 is in the closed position as in FIG. 3, the spring 66 causes the washer 70 to press against the upper camming surface 74, lifting the lower spring 82 off of the free end 90 of the seesaw linkage 86. The weight acting on the right hand portion of the linkage 86 causes the right side of the linkage to fall downward, closing the drain valve 40.- When the overflow plate 26 is lifted up to the open position, the spring 68 causes the washer 70 to press against the second camming surface 76, lowering the spring 82 into contact with the free end 90 of the seesaw linkage 86, and the added force from the spring 82 causes the linkage 86 to rotate counterclockwise about the fulcrum 88, thereby opening the drain valve 40.

It will be noted, particularly in FIGS. 1 and 2, that, when the overflow plate 26 is in the closed position, it is flush with the inner surface of the vertical bathtub wall 14 to provide a smooth, substantially continuous surface against which a bather can comfortably lean. The recessed portion 24 of the end wall 14 permits the overflow plate 26 to be recessed in the tub wall to provide this smooth, flush surface.

In order to install the drain valve arrangement on the tub 10, the inner piece 30 is connected to the fixed member 44 by means of the hinge pin 48. The drain pipe extensions 102 and 52 are connected to their respective openings 18, 20. The extension 102 is threaded onto the flanged piece 104 which forms the rain hole 18. The drain extension 52 is bolted to the fixed member 44 as was described earlier, with the installer extending his screw driver through the holes 51 in the inner piece 30 to reach the bolts 50. Then, the vertical linkage 78 is assembled with the adjustment arm and the spring 82. The leg 105 of the linkage 78 is inserted through the slot 106 of the adjustment arm 80 and into the upper hole 108 of the nut 110, and the bolt 112 then secures the nut 110 at the desired position on the adjustment arm 80 by being threaded into the lower hole 114.

The spring 66 and washers 68, 70 are placed on the rocker arm 62 and held in place by a cotter pin 69. The vertical linkage 78 is hooked onto the end of the rocker arm 62, and the linkage 78, together with the adjustment arm 80 and spring 82 are moved under the indentation 71 in the fixed member 44, through the overflow opening 20, and are lowered down through the drain pipe extension 52. Before the rocker arm 62 passes the fixed member 44, a pin 65 is extended through the hole 64 in the rocker arm 62. The pin 65 enters the horizontal recess 67 in the fixed member 44, and, when the washer 70 is brought into contact with one of the camming surfaces 74, 76, the pin 65 is pressed against the recess 67 in the fixed member 44, thereby mounting the rocker arm 62 on the fixed member 44. The outer piece 28 is then installed over the inner piece 30 of the lever arm 26 as described earlier. Then, the see-saw assembly is connected to the drain valve 40 and is threaded into position with the free end 90 entering first through the drain hole 18. The individual pieces of the see-saw assembly flex inward relative to each other in order to get around the bend 100 in the pipe 102.

When the overflow and drain control assembly is installed as described above, the bather need only pivot the overflow plate up and down in order to control the drain valve. When the drain valve is closed, the bather has a smooth, substantially continuous surface against which to recline.

It will be obvious to those skilled in the art that modifications may be made to the preferred embodiment described above without departing from the scope of the present invention.

For example, the plate may pivot on its side edge or about another axis (rather than at the top). Also, the particular nature of the lever or other operator used could be changed. Thus, the claims should be examined to determine the scope of the present invention.

What is claimed is:

1. A bathtub drain valve control arrangement, comprising:

a substantially vertical bathtub wall defining an overflow opening which is adapted to communicate with a downwardly directed drainpipe;

a bathtub floor defining a drain opening which is adapted to communicate with said drainpipe:

a drain valve for opening and closing fluid communication through said drain opening;

an overflow cover movably mounted adjacent one end on said substantially vertical bathtub wall so as to substantially conceal said overflow opening, said overflow cover adapted to move between open and closed positions and having a generally smooth outer surface, such that, in said closed position, said overflow cover is substantially flush with said vertical bathtub wall to follow the contours of the wall to provide a surface against which a bather could comfortably lean; and a linkage connection said overflow cover and said drain valve, said linkage including a first linkage member pivotally connected to said overflow cover at a pivot point spaced from said mounting of said overflow cover and a second linkage member pivotally connected intermediate its ends to said bathtub wall, said second linkage member also being pivotably connected adjacent one end to said first linkage member, and linkage means connected between the other end of said second linkage member and said drain valve such that by moving said overflow cover to the open position causes one end of said second linkage member to rise and the other end to be lowered and said linkage means opens said drain valve, and moving said overflow cover to the closed position causes one end of said second linkage member to be lowered and the other end to be raised and said linkage means closes said drain valve.

2. A bathtub drain valve control arrangement as recited in claim 1, wherein said substantially vertical bathtub wall defines a recessed pocket surrounding said overflow opening such that, in its closed position, said overflow cover is recessed in said wall.

3. A bathtub drain valve control arrangement as recited in claim 2, wherein said overflow plate is pivotably mounted at its upper end and has a free lower end.

4. A bathtub drain valve control arrangement as recited in claim 3, wherein said recessed pocket extends slightly beyond said free lower end of said overflow cover when said overflow cover is in the closed position in order to permit water to readily reach said overflow opening by passing along said recessed pocket and in order to permit a person's fingers to reach under said free lower end of said overflow cover to move said cover to its open position.

* * * * *

UNITED STATES PATENT AND TRADEMARK OFFICE

CERTIFICATE OF CORRECTION

PATENT NO. : 4,796,310

DATED : January 10, 1989

INVENTOR(S) : Robert Freville and Philip Segor

It is certified that error appears in the above-identified patent and that said Letters Patent is hereby corrected as shown below:

| | |
|---|---|
| Column 4, line 40 | "40.-" should read --40.-- |
| Column 4, line 61 | "rain" should read --drain-- |
| Column 5, line 49 | ":" should read --;-- |
| Column 6, line 13 | "connection" should read --connecting-- |

Signed and Sealed this

Eleventh Day of July, 1989

*Attest:*

*Attesting Officer*

DONALD J. QUIGG

*Commissioner of Patents and Trademarks*